United States Patent [19]

Channell

[11] Patent Number: 4,930,982

[45] Date of Patent: Jun. 5, 1990

[54] SUCTION INLET BOWL FOR A SUBMERSIBLE PUMP

[75] Inventor: Alan B. Channell, Ashland, Ohio

[73] Assignee: McNeil (Ohio) Corporation, St. Paul, Minn.

[21] Appl. No.: 275,407

[22] Filed: Nov. 18, 1988

[51] Int. Cl.[5] ..... F04D 13/08

[52] U.S. Cl. ..... 415/121.2; 415/901

[58] Field of Search ..... 415/121.2, 901, 121 G; 417/424.1, 424.2, 423.9, 423.3

[56] References Cited

U.S. PATENT DOCUMENTS

| | | | |
|---|---|---|---|
| 2,255,545 | 9/1941 | Hait | 417/423.3 X |
| 2,446,521 | 8/1948 | Blom | 417/423.3 X |
| 2,648,286 | 8/1953 | Bergh | 417/423.3 X |
| 2,670,686 | 3/1954 | Bergh | 417/423.3 X |
| 3,033,125 | 5/1962 | Pleuger | 415/121.2 |
| 3,487,432 | 12/1969 | Jensen | 415/901 X |
| 3,521,970 | 7/1970 | Deters | 417/423.3 |
| 4,019,836 | 4/1977 | Deters | 417/360 |

FOREIGN PATENT DOCUMENTS

| | | | |
|---|---|---|---|
| 440990 | 2/1927 | Fed. Rep. of Germany | 417/424.2 |
| 520040 | 4/1940 | United Kingdom | 417/423.3 |

OTHER PUBLICATIONS

F. E. Myers, SJ Series Submersible Pumps-Brochure dated 11/87, four pages.

Lowara, 4" Submersible Pump-Catalog Page, 1986.

Tait Pumps, 4 Inch Shark Submersible-Catalog Section 100, pp. 1 and 2, 1983.

Red Jacket Renegade Pump-Three brochure pages, 4/85.

Red Jacket Water Bear Pump-One brochure page, 8/86.

Bill Brandt's Very Best-One page flier, 1980.

Dempster Submaster-Catalog page, 1981.

Gould Series T Submersible Pumps-One page flier, 1985.

Griswold Deming-Catalog page, 3/83.

*Primary Examiner*—Everette A. Powell, Jr.

*Attorney, Agent, or Firm*—Renner, Kenner, Greive, Bobak, Taylor & Weber

[57] ABSTRACT

A submersible pump (10) consists of a pump unit (12) driven by a motor (11) and a suction inlet bowl (13) which draws in and filters fluid and provides the same to the pump unit (12) upon activation of the motor (11). The suction inlet bowl (13) includes a generally cylindrical upper portion (31) adapted to attach to the pump unit (12) and a generally cylindrical base (14) adapted to be attached to the motor (11). A fluid inlet portion (20) is located between the upper portion (31) and the base (14) and is recessed radially inwardly of the outer periphery of the base (12) and upper portion (31). The fluid inlet portion (20) includes a plurality of generally vertical slots (27) through which the fluid may pass and be filtered thereby.

14 Claims, 4 Drawing Sheets

SUCTION INLET BOWL FOR A SUBMERSIBLE PUMP

TECHNICAL FIELD

This invention relates to a suction inlet bowl which is positioned between the motor and the pump stages of a submersible pump. More particularly, this invention relates to such a suction inlet bowl which has a strainer to filter out undesirable materials built integrally therein.

BACKGROUND ART

A suction inlet bowl in a submersible pump is a device which represents the fluid input to the pump and is situated between and normally connects the pump motor to the typical pump stages including impellers, diffusers and the like. In order to protect the pump from deleterious particulate material such as large clumps of sand, sticks, chunks of rust from the well casing, and the like often found in the environment in which the pump is working, the inlet to the suction inlet bowl is normally covered by a band-like separate screen-like strainer with small openings therein. Such prior art strainers normally take on the cylindrical shape of the pump and as such come into close contact with the well casing, usually scraping the sides of the well as the pump is being positioned therein. Such close contact and engagement with the walls of the well often dislodges sediments which have built up on the inside of the well casing causing a potential clogging of the strainer even before extensive operation of the pump.

Moreover, even through normal operation the small holes in the strainer often clog up with muck or iron oxide found in the environment of the operation of the pump. Thus, in the prior art the strainer is designed to be removed and either cleaned or replaced. Unfortunately with all prior art designs having such a removable strainer, it must also be removed, even if not clogged, if the motor is to be serviced or replaced. In instances, characterized by some prior art, where the suction bowl is not a separate item but rather an integral part of the motor, the bowl itself cannot be replaced without replacing the motor.

Finally, while adequately protecting the pump from the abrasive materials in the well environment, the prior art strainers with the small holes therein not only tend to clog easily but they also create a high inlet fluid velocity which reduces the efficiency of the pump.

DISCLOSURE OF THE INVENTION

It is thus a primary object of the present invention to provide a one-piece suction inlet bowl and strainer for a submersible pump.

It is another object of the present invention to provide a suction inlet bowl for a submersible pump, as above, in which the strainer which covers the inlet to the pump is recessed radially inwardly of the outer periphery of the suction bowl to help prevent clogging thereof.

It is a further object of the present invention to provide a suction inlet bowl for a submersible pump, as above, wherein the strainer includes a plurality of vertical slots.

It is yet another object of the present invention to provide a suction bowl for a submersible pump, as above, wherein the vertical slots are not on a tangent to the generally cylindrical profile of the suction bowl to reduce the potential clogging thereof.

It is a still further object of the present invention to provide a suction bowl for a submersible pump, as above, with an overall larger input area than the prior art thereby creating a decrease in input fluid velocity and therefore a more efficient pump.

It is an additional object of the present invention to provide a suction bowl for a submersible pump, as above, with the capability of adding a second straining device to further protect the pump unit from deleterious materials.

These and other objects of the present invention, which will become apparent from the description to follow, are accomplished by the improvements hereinafter described and claimed.

In general, a suction inlet bowl according to the present invention includes a generally cylindrical upper portion adapted to attach to a pump unit. A lower generally cylindrical base is adapted to attach to a motor which drives the pump. A fluid inlet portion extends between the upper portion and the base and includes a plurality of generally vertical slots recessed radially inwardly of the outer periphery of the upper portion and the base.

PREFERRED EMBODIMENT FOR CARRYING OUT THE INVENTION

Figure 1:
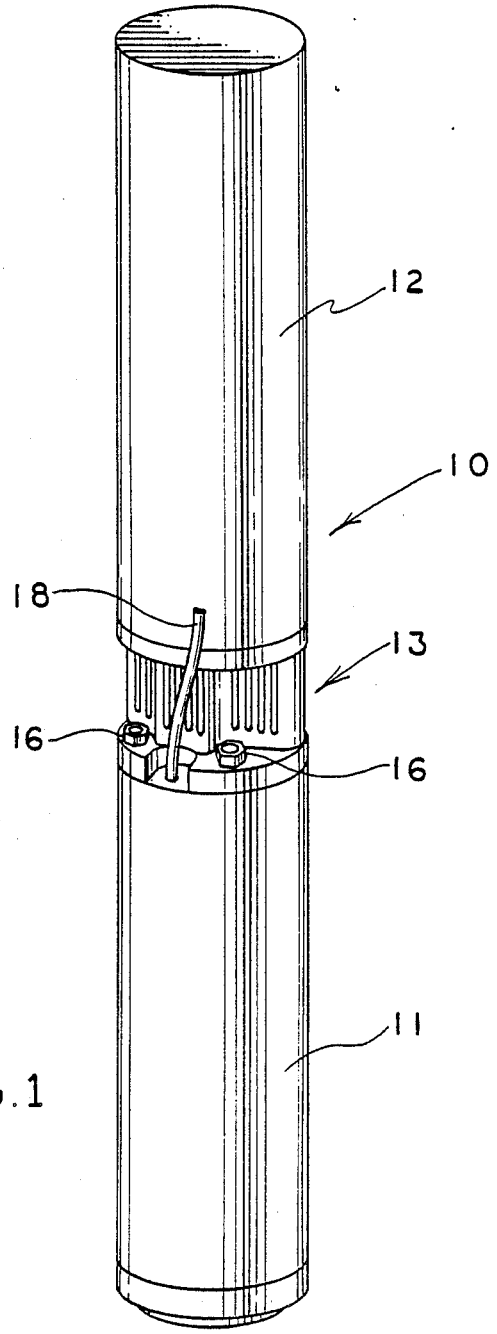
FIG. 1 is a somewhat schematic perspective view showing the suction inlet bowl of the present invention in its environment with a pump unit and motor forming a submersible pump.

A submersible pump is somewhat schematically shown in FIG. 1 and indicated generally by the numeral 10. Pump 10 includes a motor 11 which drives the impellers (not shown) of a conventional pump unit 12. Motor 11 and pump unit 12 can be of any conventional type and size with, for example, pump unit 12 consisting of any number of pump stages as required dependent upon the desired capacity of the pump 10. Pump 10 also includes a suction inlet bowl indicated generally by the numeral 13 interposed between motor 11 and pump unit 12.

Figure 6:
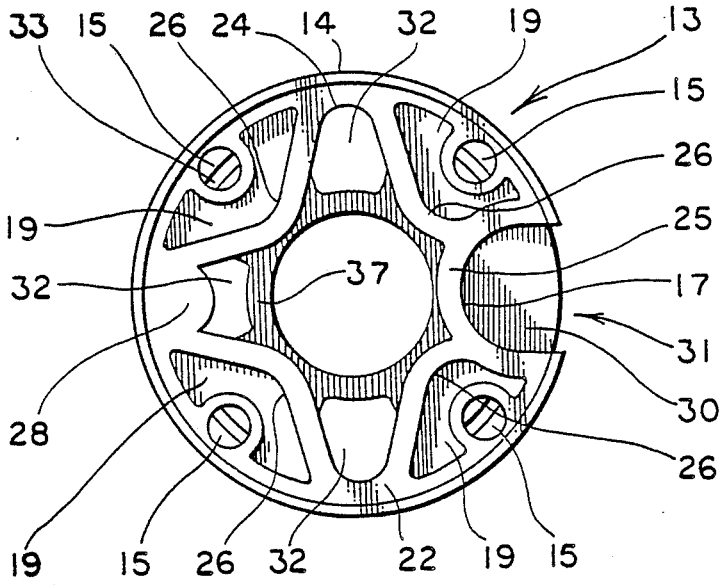
FIG. 6 is a bottom plan view of the suction inlet bowl shown in FIG. 4.

Suction inlet bowl 13 is a one-piece unit preferably molded of a suitable plastic material, such as polycarbonate, and takes on an overall generally cylindrical configuration. The lower portion of suction inlet bowl 13 is formed as a generally cylindrical base 14 having four apertures 15 extending therethrough so that motor 11 can be attached thereto, as by bolts 16 (FIG. 1). Base 14 is also provided with an arcuate cutout portion 17 extending therethrough so that the power wire 18 (FIG. 1) of motor 11 may extend from the motor 11 and upward to a power source. As best shown in FIG. 6, base 14 is hollowed out at four areas 19 on the bottom thereof around apertures 15 primarily for the reduction of material in the molding process.

Extending upwardly from base 14 is the suction inlet strainer portion of suction inlet bowl 13 which is generally indicated by the numeral 20. As probably best shown in FIG. 7, suction inlet strainer 20 includes a continuous arcuate or lobed wall indicated generally by the numeral 21 and having three full lobes 22, 23 and 24 and one truncated lobe 25. The radially outermost portions of lobes 22, 23 and 24 generally coincide with the outer periphery of base 14 and the outer edge of truncated lobe 25 coincides with but is above the surface of arcuate cutout portion 17 of base 14. Between adjacent of lobes 22, 23, 24 and 25, the walls of suction inlet strainer 20 form concave crenelations 26 which are thus all recessed radially inwardly from the outer periphery of suction inlet bowl 13. These crenelation walls are located above and at the same general circumferential location as apertures 15 in base 14 so that facile access may be had to bolts 16 when attaching or removing motor 11.

Each concave crenelation wall 26 and truncated lobe 25 is provided with a plurality of generally vertical parallel slots 27 through which, as will hereinafter be described in more detail, inlet fluid passes. Crenelation walls 26 with slots 27 thus act as a strainer to filter out, and otherwise prohibit the passage of, material which might be deleterious to pump unit 12.

Figure 7:
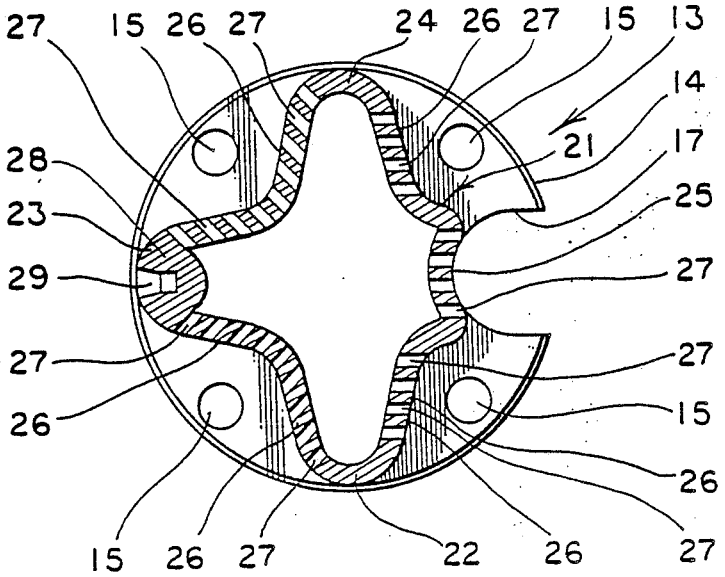
FIG. 7 is a sectional view taken substantially along line 7—7 of FIG. 4.

As best shown in FIG. 7, no slot 27 is in a plane parallel to a plane tangent to the generally cylindrical outer surface of suction inlet bowl 13 or, stated another way, no slot 27 is perpendicular to a radius of suction inlet bowl 13. By utilizing slots 27 for the fluid inlet, the inlet area is increased over that of the prior art thus decreasing the inlet velocity making the pump more efficient. However, even though the inlet area is increased, because the openings of slots 27 are not tangent to the radial fluid flow, the effective opening of the width of the slots, as seen by the particles in the input fluid, is smaller than their actual width. This increases the filtering ability of the suction inlet strainer 20 even though the total inlet area is larger.

Figure 2:
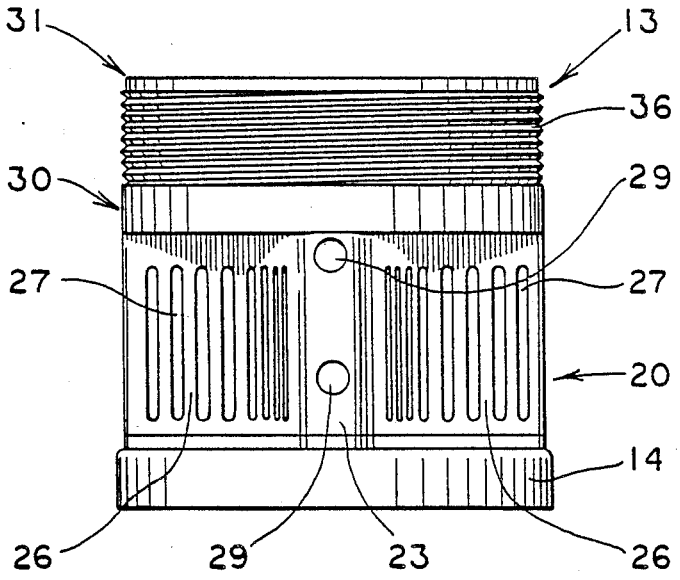
FIG. 2 is an elevational view of the suction inlet bowl of the present invention.
Figure 3:
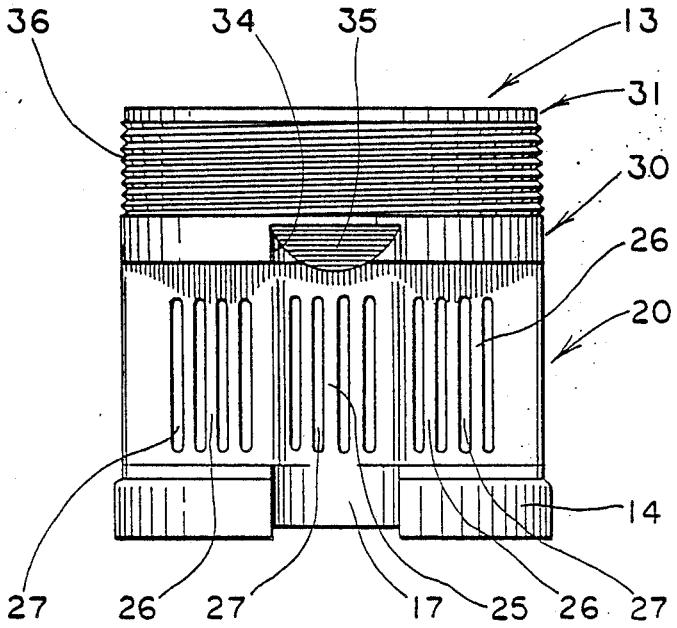
FIG. 3 is an elevational view showing the diametrically opposite side of the suction inlet bowl shown in FIG. 2.
Figure 4:
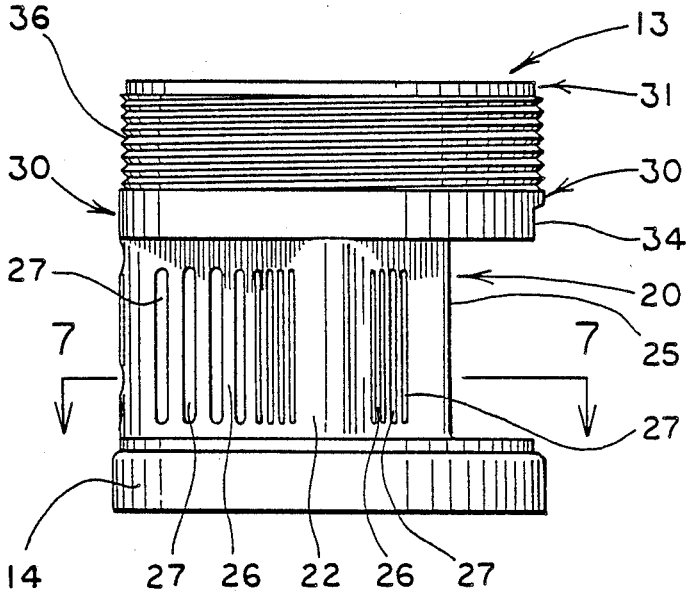
FIG. 4 is an elevational view looking at the suction inlet bowl shown in FIG. 2 from the right hand side.

Suction inlet bowl 13 is also capable of even more refined screening, if desired, in environments where a larger amount of sediment in the fluid might be expected. To that end, lobe 23 is reinforced, as at 28 (FIG. 7), and apertures 29 (FIG. 2) are provided therein so that a conventional bandtype strainer can be attached circumferentially around suction inlet strainer 20. In this manner fluid can be filtered once in a conventional manner before being further filtered by inlet strainer 20.

Figure 5:
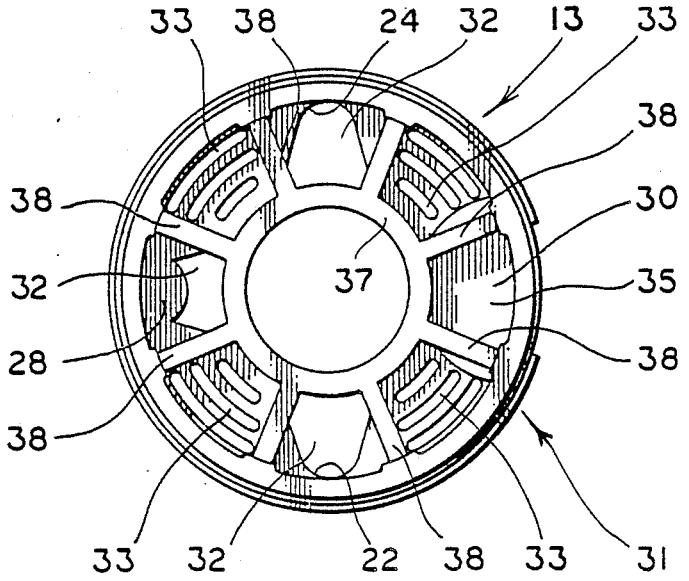
FIG. 5 is a top plan view of the suction inlet bowl shown in FIG. 4.

Positioned above suction inlet strainer 20 is a generally horizontally extending cylindrical pump inlet shelf, indicated generally by the number 30, above which is a generally cylindrical pump unit attachment portion generally indicated by the numeral 31. Inlet shelf 30 includes a plurality of apertures 32, the shape of which are defined by the tops of lobes 22, 23 and 24. Fluid passing through slots 27 is drawn upwardly through apertures 32, through pump unit attachment portion 31 and into pump unit 12. Shelf 30 is also provided with a series of arcuate slots 33 (FIG. 5) above the area radially outside of suction inlet strainer 20, that is, above and radially outside of the concave crenelations 26 thereof. Fluid may also be drawn into pump unit 12 directly through slots 33, as well as slots 27, thereby increasing the overall inlet area. Of course, slots 33, like slots 27, do not permit the passage of material which may be deleterious to pump unit 12.

The outer cylindrical surface of shelf 30 is notched, as at 34, creating a bevelled solid surface 35 extending from the top of notch 34 to the top of inlet strainer 20 at the area of the top of truncated lobe 25. Notch 34 and surface 35, being above cutout portion 17 in base 16, accommodates wires 18 from motor 11 passing through cutout portion 17 so that the wires are not abrading against the otherwise cornered surface of shelf 30.

Pump attachment portion 31 of suction bowl 13 is provided with threads 36 extending substantially the entire vertical extent of the cylindrical outer periphery thereof for mating engagement with threads in the housing of pump unit 12. Internally, pump attachment portion 31 provides a substantially open access for fluids, strained by suction inlet strainer 20, to be received by pump unit 12. However, primarily to assist in assuring that threads 36 are accurately molded to close tolerances, a cylindrical hub 37 extends upwardly from shelf 30 and within pump attachment portion 31. By using a diaphragm gating method of plastic injection at hub 37, plastic is injected at 360° and moves through radially spaced ribs 38 uniformly and symmetrically so as to more accurately form threads 36. Hub 37 and ribs 38 also, in the finished product, supply radial strength to pump attachment 31.

When submersible pump 10 is assembled as described hereinabove, the drive shaft of motor 11 extends up within suction inlet bowl 13 where it is coupled to the pump shaft that extends downwardly from pump unit 12 through hub 37 of pump attachment portion 31 of suction inlet bowl 13. With pump 10 in position for operation, for example in a well, activation of motor 11 turns the impellers of the stages of pump unit 12 creating a vacuum, and atmospheric pressure on the water table pushes water into suction inlet bowl 13 to fill the vacuum. The operation of pump 10 thus draws water generally radially toward vertical slots 27 which, as previously indicated, are not on a tangent to the generally cylindrical periphery of inlet bowl 13 thereby presenting an effective opening for deleterious particles which is less than the actual inlet capacity provided by the slots. This also causes the inlet fluid to change directions as it is entering suction inlet bowl 13 which tends to have a cleaning effect on slots 27. Fluid which thus enters inlet bowl 13 then passes upwardly into pump unit 12, as previously described, passing through apertures 32 in inlet shelf 30 and also passing between the pump shaft and hub 37. Also as previously described, the vacuum effect upon activation of motor 11 will also draw fluid upwardly through arcuate slots 33 in shelf 30. When the pump is deactivated, a certain amount of backwash is created and any accumulation of sand or other potential plugging agents in slots 27 or 33 will be effectively removed and washed outside of pump 10.

It should thus be appreciated that a suction inlet bowl for a submersible pump constructed according to the concept of the present invention represents a substantial improvement in the art and otherwise accomplishes the objects of the present invention. While the preferred embodiment of the present invention has been described herein, it should be appreciated that the teachings herein are not intended to be so restricted. Other embodiments which might utilize the teachings herein set forth are intended to be within the scope of the subject invention.

What is claimed:

1. A submersible pump including a pump unit driven by a motor, and a suction inlet bowl, the inlet bowl comprising a generally cylindrical upper portion adapted to attach to the pump unit, a generally cylindrical base adapted to attach to the motor, and a fluid inlet portion between said upper portion and said base, said fluid inlet portion including a continuous arcuate wall having a plurality of lobes generally at the periphery of said generally cylindrical upper portion and base and concave portions between adjacent of said lobes, and a plurality of generally vertical slots through which fluid may pass positioned in said concave portions such that none of said vertical slots lie in a plane parallel to a plane tangent to said generally cylindrical upper portion and base.

2. A submersible pump as in claim 1 further comprising an inlet shelf at the bottom of said upper portion and at the top of said fluid inlet portion.

3. A submersible pump as in claim 2 wherein said shelf includes means to permit the passage of fluid which has passed through said vertical slots to said upper portion.

4. A submersible pump as in claim 3 wherein said shelf includes a plurality of generally arcuate slots to permit the passage of fluid which has not passed through said vertical slots to said upper portion.

5. A submersible pump as in claim 4 wherein said upper portion includes means to permit the passage of fluid to the pump unit.

6. A submersible pump as in claim 1 wherein the motor is powered through wires extending out of the motor, said base having an arcuate cutout portion for the passage of the wires from the motor.

7. A submersible pump as in claim 6 wherein said base is provided with a plurality of motor mounting apertures.

8. A submersible pump as in claim 6 further comprising an inlet shelf having a generally cylindrical outer surface and located between said upper portion and said fluid inlet portion, said outer surface being notched at a circumferential location above said cutout portion to provide the safe passage of the wires.

9. A submersible pump as in claim 1 wherein said upper portion includes thread means on the outer periphery thereof to engage the pump unit.

10. A submersible pump as in claim 9 wherein said upper portion includes a hollow cylindrical hub member and radially spaced ribs extending from said hub member to the cylindrical surface of said upper portion, the spaces between said ribs providing for the passage of fluid from said fluid inlet portion to the pump unit.

11. A suction inlet bowl for a submersible pump comprising, a generally cylindrical base member, a generally cylindrical upper portion, together said base member and said upper portion defining a generally cylindrical outer periphery of the inlet bowl, fluid inlet strainer means between said base member and said upper portion, said strainer means including a continuous wall having a plurality of lobes with outermost portions generally coinciding with said generally cylindrical outer periphery of the inlet bowl and concave portions between adjacent of said lobes, and a plurality of slot openings in said concave portions of said wall for the passage of fluid therethrough, none of said slot openings lying in a plane parallel to a plane tangent to said generally cylindrical outer periphery of the inlet bowl, and means in said upper portion to permit the passage to the submersible pump of fluid passing through said slot openings.

12. A suction bowl as in claim 11 wherein one of said lobes is provided with means to attach a second strainer means around said strainer means.

13. A suction bowl as in claim 12 further comprising second means in said upper portion to permit the passage to the submersible pump of fluid which has not passed through said slot openings.

14. A suction bowl as in claim 13 wherein said second means includes arcuate slot means straining the fluid passing therethrough.

* * * * *

UNITED STATES PATENT AND TRADEMARK OFFICE

CERTIFICATE OF CORRECTION

PATENT NO. : 4,930,982

DATED : June 5, 1990

INVENTOR(S) : Alan B. Channell

It is certified that error appears in the above-identified patent and that said Letters Patent is hereby corrected as shown below:

Column 3, line 50, "bandtype" should read --band-type--.

Column 6, line 34, "12" should read --11--.

Signed and Sealed this

Twenty-sixth Day of November, 1991

*Attest:*

HARRY F. MANBECK, JR.

*Attesting Officer*

*Commissioner of Patents and Trademarks*